United States Patent [19]

Chaffee

[11] 4,376,908

[45] Mar. 15, 1983

[54] IMPEDANCE TAPERED DEMATRON

[75] Inventor: Edwin G. Chaffee, Redwood City, Calif.

[73] Assignee: The United States of America as represented by the Secretary of the Army, Washington, D.C.

[21] Appl. No.: 220,485

[22] Filed: Dec. 29, 1980

[51] Int. Cl.[3] ..... H01J 25/34

[52] U.S. Cl. ..... 315/39.3; 313/30; 313/32; 315/3.6

[58] Field of Search ..... 313/30, 31, 32; 315/39.3, 3.6

[56] References Cited

U.S. PATENT DOCUMENTS

| | | | |
|---|---|---|---|
| 2,890,384 | 6/1959 | Dench | 313/30 X |
| 2,920,227 | 1/1960 | Dohler et al. | 315/39.3 X |
| 2,933,723 | 4/1960 | Brown | 315/39.3 |
| 2,976,454 | 3/1961 | Birdsall et al. | 315/39.3 X |
| 2,976,456 | 3/1961 | Birdsall et al. | 315/39.3 X |
| 3,387,234 | 6/1968 | Sobotka | 315/3.5 |

*Primary Examiner*—Saxfield Chatmon, Jr.
*Attorney, Agent, or Firm*—Nathan Edelberg; Jeremiah G. Murray; Edward Goldberg

[57] ABSTRACT

A crossed field amplifier including a linear, ladder type slow wave device including an array of closely spaced parallel U-shaped rungs with a pair of oppositely wound helices running side-by-side inside said array, and a pair of trimmers running along each side of said array of rungs, the trimmer height at the input or cathode end of said slow wave structure being increased compared to its height for the remainder of said slow wave device.

7 Claims, 3 Drawing Figures

IMPEDANCE TAPERED DEMATRON

BACKGROUND OF THE INVENTION

This invention relates to microwave electron tubes and more particularly to certain modifications to the slow wave structure of a crossed-field amplifier (CFA) known as a DEMATRON. This name is an acronym for the term "distributed-emission magnetron amplifier." The device includes a linear-format, ladder-type slow wave structure including a pair of oppositely wound helices and a pair of trimmers on either side of the ladder array. The slow wave structure extends along one side of the evacuated tube envelope and a cold cathode extends along the other side thereof, with a collector electrode near the output end of the device. The space between the slow wave structure and the cathode comprises the interaction space, in which energy exchange takes place between the electron beam and the rf field propagating down the slow wave structure, provided the phase velocity of the rf wave is about the same as the electron beam velocity. The DEMATRON differs from most devices in that it is rf keyed, which means that operation of the tube is initiated by the application of rf input at the cathode end of the slow wave structure, and the operation ceases again upon removal of the input. Since the cathode is cold, the standby power is zero, and no control electrode is necessary.

The invention comprises a modification of the aforementioned trimmer dimensions in the vicinity of the cathode of the device. This modification was found to increase the tube gain.

SUMMARY OF THE INVENTION

The invention comprises a crossed-field amplifier with a linear format slow wave structure of the ladder type, comprising a large plurality of U-shaped rungs with rung caps centrally disposed thereon, and a pair of oppositely wound helices running side-by-side through said U-shaped rungs, with the pitch of said helices each being equal to the spacing of said rungs, said slow wave device further including a pair of elongated trimmers of rectangular cross section running along each side of the array of U-shaped rungs and connecting the ends of all adjacent rungs, the trimmer height in approximately the first one third of the slow device being increased compared to its height for the remainder of the device.

Thus an object of the invention is to provide a crossed field microwave amplifier of improved performance including a slow wave structure with a trimmer of increased height in the region of the cathode.

Another object of the invention is to increase the interaction impedance and gain of a DEMATRON by providing it with a ladder type slow wave structure with a trimmer of tapered height, the trimmer height in the approximate first one third of the slow wave structure being increased in height by approximately one-twentieth of an inch compared to its height for the last two-thirds of the slow wave structure.

Further details of the invention will become apparent from the following detailed description and the drawings.

DETAILED DESCRIPTION OF A PREFERRED EMBODIMENT

Figure 1:
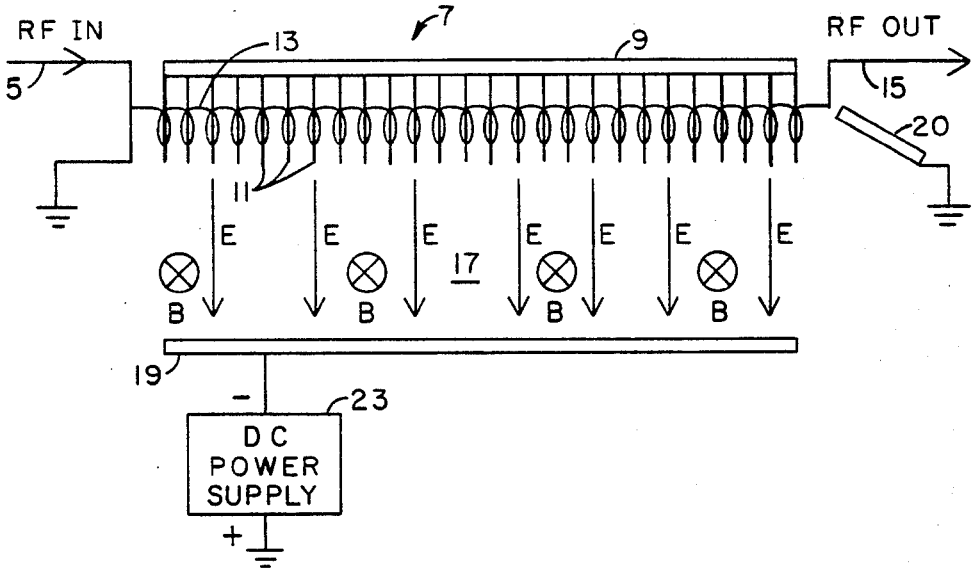
FIG. 1 is a schematic diagram of a DEMATRON, which illustrates the structure and mode of operation thereof.
Figure 2:
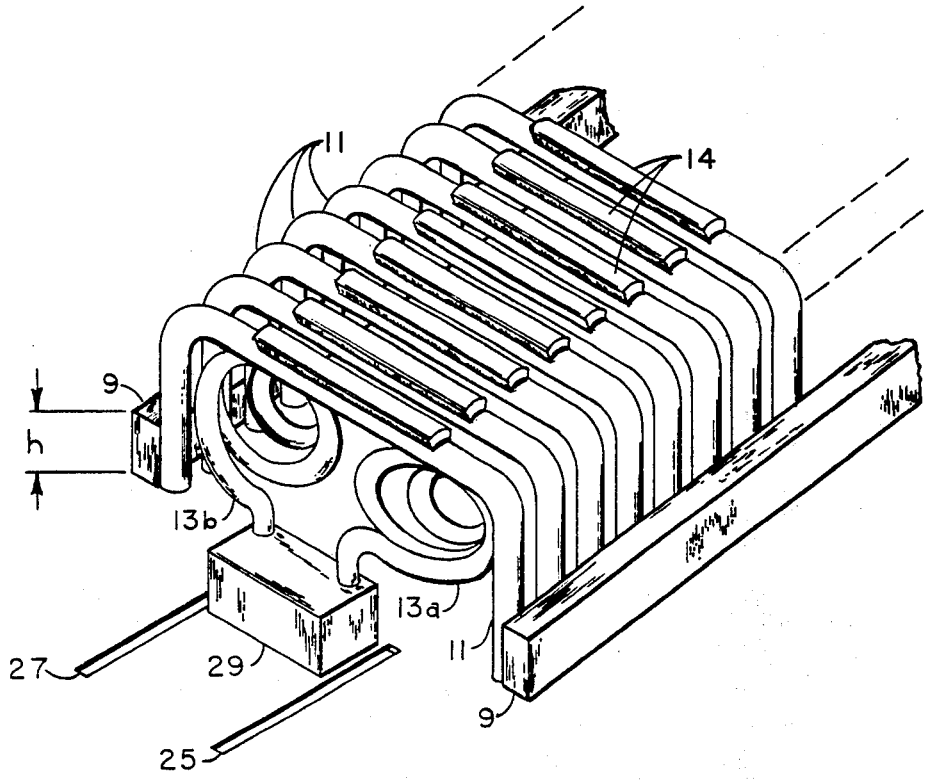
FIG. 2 is a pictorial view of a ladder type slow wave device of the type used in the CFA of the present invention.

In the schematic of FIG. 1, the DEMATRON depicted therein includes a slow wave structure 7 of the ladder type, comprising a large number of U-shaped rungs 11, arranged in closely spaced parallel relationship with a pair of oppositely wound helices 13 running side-by-side inside said array of U-shaped rungs. The two helices are tied together at each end of the device. The rf input signal to be amplified is applied in parallel to the two helix ends at the left or input end of the structure, and the amplified signal is taken from the output or right end thereof. The slow wave device includes a pair of trimmers running along either side of the array of rungs and connecting adjacent open ends of the rungs, as well as rung caps on each rung, for properly shaping the rf field in the gaps between rungs. Further details of the slow wave structure are shown in FIG. 2. On the opposite side of the tube envelope is located the cold cathode 19. This electrode is connected to the negative terminal of power supply 23, the positive terminal of which is grounded. The slow wave structure is also grounded, so that it forms the positive electrode for establishing the electric field lines E, in the interaction space 17 between it and the negatively charged cathode. The collector 20 located adjacent the output end of the slow wave structure is also grounded. An external magnet produces a uniform dc magnetic field B, directed into the plane of the paper, as indicated by the symbol.

In operation, the rf input is applied to the helices, which have a pitch equal to the rung spacing and are oppositely wound. This structure results in a concentration of the rf field in the region of the rung caps 14 (see FIG. 2), and a fringing effect which brings the rf field into the interaction space 17. The applied rf frequency, the helix pitch and rung spacing are such that the phase velocity along the line is comparable to the electron beam velocity, and power transfer can occur. The input rf initially accelerates some of the free electrons in the interaction space and the action of the crossed E and B fields causes these to curve back toward the cathode. Some of these electrons have sufficient energy to cause secondary emission at the cathode and the current rapidly builds up.

FIG. 2 shows more details of a ladder type slow wave structure. The U-shaped ladder rungs 11 are hollow tubes made of monel metal with a coolant circulated in the hollow center thereof. The rung caps 14 and the trimmers 9 aid in shaping the rf field, so that it can interact with the electron beam for maximum energy transfer. The helix **13*a* is left hand wound, as shown, and helix 13*b* right hand wound. The helices are attached to and supported by the inside of the rungs, for example, by brazing. The two helices terminate in ramp extension 29, which forms part of a waveguide through which the input rf is applied to the DEMATRON. This waveguide includes a ridged horn, not shown, which terminates in the ramp extension 29 and a pair of irises 25 and 27. The ridged horn functions as an impedance transformer. It should be noted that the slow wave structure of FIG. 2 is inverted relative to that of FIG. 1, and thus the interaction space would be above the rung caps 14 in FIG. 2. The trimmers 9** are brazed to the outside to the rung array, as shown, and thus aid in supporting the structure as well as electrically modifying the field distribution thereon.

In the microwave tube in which this invention was reduced to practice, the ladder type slow wave structure comprised 114 rungs. The rungs had outside diameters of 0.050 inches with a pitch or spacing between centers of 0.084 inches. The rung caps were 0.625 inches long and 0.01 inches thick. The helices had a turn diameter of 0.405 inches and were composed of 0.044 inch diameter copper wire. The width of each rung was 1.132 inches and the height thereof 0.76 inches. The frequency range of the DEMATRON was 3.1 to 3.5 gigaHertz.

Figure 3:
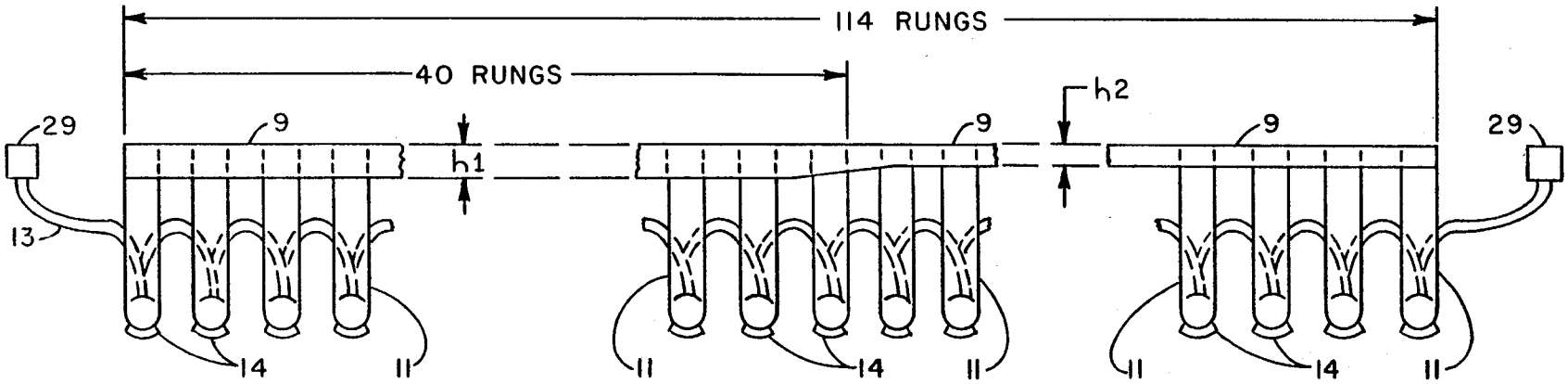
FIG. 3 is a side view of the slow wave structure of the present invention.

Details of the structure of the trimmers 9 which resulted in high gain for this device are shown in FIG. 3. This is a side elevation of a slow wave structure in accordance with the invention. It is shown broken in two places to avoid needless repetition of the 114 rungs of which it is composed. The helix 13 is shown in this side view, as well as an end view of the rung caps 14. The input or cathode end of the structure is on the left, where the helix ends are connected to ramp extension 29.

The trimmer height, $h_1$, for the first 40 rungs of the device is made, in accordance with the invention, 0.325 inches, and thereafter tapers to a height, $h_2$, of 0.275 inches. Thus about the first one third of the slow wave structure has a trimmer one-twentieth of an inch higher than the remaining two thirds. Previous tubes of this type have had trimmers with a uniform height of 0.275 inches.

The effect of the increased height in the cathode or input area is to increase the effective interaction impedance presented to the cathode. The phase velocity is increased, which reduces the rate of falloff of the rf fields. The result is that the initial electrons striking the cathode are more energetic, with a resultant increase in secondary emission. This increases the rate of buildup to full Brillouian density, and enhances the gain by allowing the tube to start at a lower input drive level. It was found that a tube incorporating the tapered height trimmers of the present invention would start at a 20 to 30 percent lower drive level than a similar tube with a prior art trimmer with a uniform height of 0.275 inches, and had a gain 1.5 db higher than such prior art tube.

While the invention has been described in connection with a preferred embodiment, variations therein will occur to those skilled in the art, thus the invention should be limited only by the scope of the appended claims.

I claim:

1. A crossed field amplifier adapted to amplify input signals in the microwave region, comprising, rf signal input and output means, means establishing an electron beam, a linear slow wave structure of the ladder type for propagating said rf signal and interacting with said beam, said slow wave structure including an array of U-shaped rungs in closely spaced parallel relationship extending from the input end to the output end, a pair of oppositely wound helices running along respective sides of said rungs inside said array, said helices having a pitch equal to the spacing of said rungs, and a pair of rf field trimmers of rectangular cross section running continuously along the outside of each side of said array of rungs and connecting the open ends of all adjacent rungs, the trimmer height being larger along a first longitudinal portion adjacent the input end and smaller along a second longitudinal portion adjacent the output end.

2. The amplifier of claim 1 where said trimmer is larger in height for approximately the first third of its length, and smaller in height for the remainder of its length.

3. A microwave amplifier of the crossed field type comprising a linear ladder type slow wave structure having a plurality of closely spaced U-shaped parallel rungs and a pair of oppositely wound helices along opposite sides within said rungs, means applying an rf input signal at one end of said slow wave structure and providing an rf output signal at the other end, means establishing an electron beam for interaction with said slow wave structure, said slow wave structure including a pair rf field trimmers of tapered height running continuously along the outside of said slow wave structure on each side thereof, the height of said trimmers being increased in the input region of said slow wave structure and tapering to a reduced height about one third of the way along said structure and continuing at said reduced height for the remaining length of said structure.

4. The microwave amplifier of claim 3 wherein said slow wave structure rungs each include a centrally located rung cap thereon.

5. A microwave amplifier comprising an evacuated envelope with a linear ladder type slow wave structure on one side thereof and a cold cathode on the opposite side of said envelope, a collector electrode arranged near the output end of said slow wave structure, means to apply a positive dc voltage to said slow wave structure and said collector and a negative dc voltage to said cathode to establish a steady electric field within said envelope and provide an electron beam, means to establish a dc magnetic field at right angles to said steady electric field, means to apply an rf microwave input signal to one end of said slow wave structure for interaction with said electron beam and means to withdraw an amplified signal from the other end thereof, said slow wave structure including a pair of rf field trimmers running the full length thereof on opposite sides thereof, said trimmers being tapered in height with a first given continuous height for substantially the first one third of their lengths, said given height tapering to a second reduced continuous height for the remainder of their lengths

6. The device of claim 5 wherein said slow wave structure includes a plurality of closely spaced U-shaped parallel rungs and a pair of longitudinal oppositely wound helices secured to opposite sides within said rungs, each rung having a central cap thereon, said trimmers being secured along the outside of said rungs.

7. The device of claim 6 wherein the helices have a pitch equal to the rung spacing and said means applying an rf input signal includes a waveguide ramp at the input ends of said helices.

* * * * *